United States Patent [19]

Klein

[11] Patent Number: 4,473,721

[45] Date of Patent: Sep. 25, 1984

[54] HIGH-FREQUENCY LOUD SPEAKER

[76] Inventor: Siegfried Klein, 42, rue de la tour, F-75009, France

[21] Appl. No.: 354,165

[22] Filed: Mar. 3, 1982

[30] Foreign Application Priority Data

Apr. 1, 1981 [FR] France ..... 81 06511

[51] Int. Cl.[3] ..... H04R 7/12

[52] U.S. Cl. ..... 179/110 A; 181/173; 181/144

[58] Field of Search ..... 179/110 A, 115.5, 115.5 PS, 179/115.5 ME, 1 HF, 100 L, 181 R; 181/173, 144; 310/323, 328, 334, 347

[56] References Cited

U.S. PATENT DOCUMENTS

| | | | |
|---|---|---|---|
| 1,653,045 | 12/1927 | Holinger | 181/173 |
| 1,735,860 | 11/1929 | Hutchison | 181/144 |
| 2,064,911 | 12/1936 | Hayes | 181/173 |
| 2,832,843 | 4/1958 | Miessner | 179/115.5 ME |
| 3,686,446 | 8/1972 | Manger | 179/115.5 ME |

FOREIGN PATENT DOCUMENTS

| | | | |
|---|---|---|---|
| 63094 | 10/1982 | European Pat. Off. | 179/110 A |
| 218743 | 6/1924 | United Kingdom | 179/181 R |
| 248122 | 3/1926 | United Kingdom | 179/115.5 |

*Primary Examiner*—Harold I. Pitts
*Assistant Examiner*—L. C. Schroeder
*Attorney, Agent, or Firm*—Steele, Gould & Fried

[57] ABSTRACT

A high-frequency loudspeaker has a movable diaphragm which is moved to and fro by an actuating unit. The actuating unit, under the impulses of a signal to be converted into sound waves, changes in dimension in at least two opposed directions. The diaphragm is made up of two rigid hemispherical shell diaphragms which are connected together through a resilient ring to constitute a pulsating, closed sphere. An actuating unit is disposed inside the sphere and is firmly connected to the two diaphragms, so that the forces emanating therefrom are imparted to the two diaphragms and in directions at right angles to the plane connecting between the two diaphragms. A device is provided for equalizing the atmospheric pressure within and outside the closed, spherical body. Instead of connecting the diaphragms through a ring it is also possible to have the diaphragms merge without contact through a labyrinthic seal.

11 Claims, 7 Drawing Figures

HIGH-FREQUENCY LOUD SPEAKER

BACKGROUND OF THE INVENTION

1. Field of the Invention

This invention relates to a high-frequency loudspeaker, meaning a loudspeaker for sound in the high-frequency range, this having a movable diaphragm and an actuating unit connected to this diaphragm which unit, under the action of an electrical signal to be converted into sound waves, is variable in dimensions along at least two opposite directions. High-frequency loudspeakers of this kind are called "tweeters".

2. Prior Art

In loudspeakers of the kind set forth the diaphragm is usually in the form of a hemisphere and is then called a spherical loudspeaker. There are however high-frequency loudspeakers with other forms of diaphragm, for example funnel-shaped. All these loudspeakers however send out sound in a selected direction. As a consequence, to obtain a good stereophonic or quadrophonic effect it is necessary for these known loudspeakers to be orientated in such a way that the sound waves they send out converge at one point or one listening area. The hearer must be located in this convergence area and this means firstly disadvantages as regards the spacial arrangement of the loudspeaker and secondly a limitation of the number of hearers who will all wish to be located in the preferred listening area. Further it is usual to house these known high-frequency loudspeakers in special housings, frequently in box-type cabinets. Arrangements of this nature increase the expense for sound systems and take up a lot of room.

SUMMARY OF THE INVENTION

It is an object of the present invention to mitigate the disadvantages of these known high-frequency loudspeakers and to improve the speaker of the type first set forth above in such a way that the emission therefrom takes place virtually in every direction so that it requires no special organisation, that it can be readily manufactured, and that it has a high sound quality and takes up little space.

These objects are met by the present invention by the provision of a loudspeaker of the kind set forth above which is so devised that the diaphragm is composed of two dimensionally-stable diaphragms which are each of substantially hemispherical shell form and are connected together by a resilient ring to constitute a closed, variable-volume body substantially of spherical shape, that the actuating unit is disposed inside this body and is firmly connected to each diaphragm so that the impulsion forces from the actuating unit are applied to the diaphragms in directions running at right angles to the plane between the two diaphragms, and that use is made of a device for equalising the atmospheric pressure within and externally of the closed body.

This loudspeaker, when an electrical signal is applied thereto, acts as a pulsating or "breathing" sphere which radiates the sound waves practically uniformly in all directions. It is therefore no longer necessary for the listener to be located in one selected direction of radiation of the sound waves, nor does the altitude of the loudspeaker have to be adapted to local circumstances. The avoidance of a need to radiate in a particular direction also has the advantage that for a listener the high sounds are not louder or softer in comparison with, say, lower sounds when he is at different parts of the room in which the sound is made. Further the loudspeaker of this invention is of small dimensions but nevertheless has a high-degree sound output. It is not necessary to install it in a housing or box and it can either be mounted on a base or hung from an appropriate suspension.

BRIEF DESCRIPTION OF THE DRAWINGS

Further features and advantages of the invention are disclosed in the remaining claims and in the following description of a number of embodiments of the invention which are illustrated in the accompanying drawings and, it is to be understood, are merely given by way of example. This description is given in more detail in reference to the accompanying drawings. In these drawings:

DETAILED DESCRIPTION OF THE PREFERRED EMBODIMENTS

Figure 1:
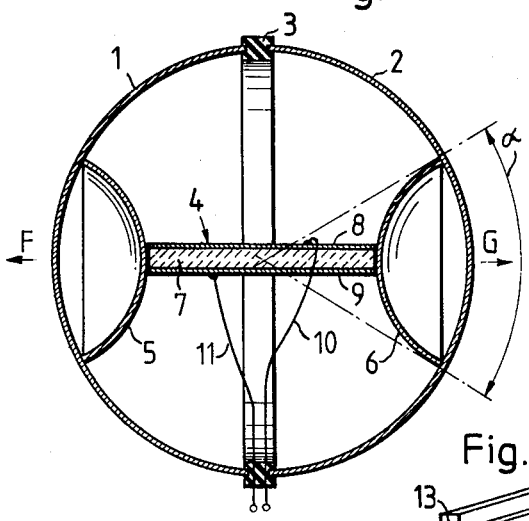
FIG. 1 is a section through a loudspeaker in accordance with the invention provided with a piezoelectric actuating unit.
Figure 4:
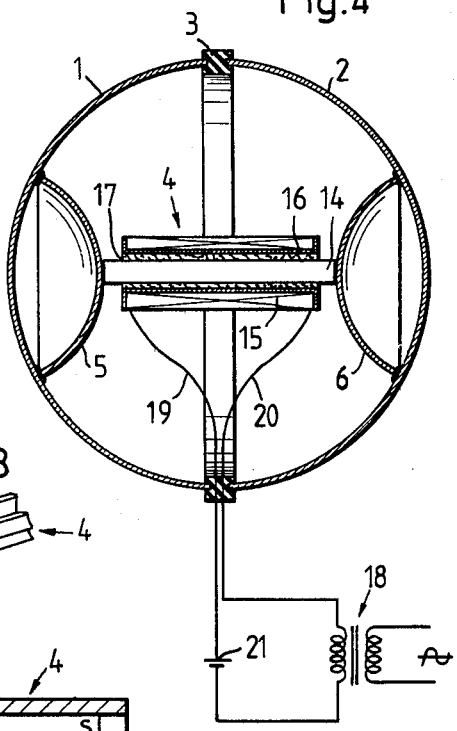
FIG. 4 is a sectional view similar to that of FIG. 1 through a loudspeaker within the invention having a magnetostrictive actuating unit.

The loudspeakers illustrated in FIGS. 1 and 4 have two diaphragms 1 and 2 of non-varying hemispherical shell form which are fastened together by a resilient ring 3, although other forms of fastening are possible. The result is to provide a pulsating or "breathing" sphere located within which is an actuating unit 4 firmly connected to the two diaphragms 1, 2.

The hemispherical or calotte-form diaphragms 1 and 2 are made from a very light material which as far as possible is of non-varying shape. In the embodiment now referred to they are assumed to be of pasteboard, although they could be made of a plastics material. The pasteboard is covered with a plastics material but could instead be impregnated with a resin or lacquer. A material such as that used for table tennis balls could be employed.

The ring 3 is made of a rubber but could instead be of some other elastomer. What is important is that it shall be soft enough to permit unrestricted movement of the diaphragm 1 and 2. In the event that the ring 3 is made of a material impermeable to air, at least one air opening (not shown) is provided to effect for an equalisation of atmospheric pressure between the interior of the closed body of spherical form and the ambient space. Alternatively this pressure balance could be provided using a ring 3 of an elastomeric foam or an air-permeable resilient material. What is imperative is only that no sound waves shall be allowed to pass from the interior to the outer space because these could cause secondary waves and acoustic short-circuits. A critical advantage of the invention is that the loudspeaker of this invention needs no kind of external aids, such as a sound baffle, to avoid acoustic short circuiting.

Figure 7:
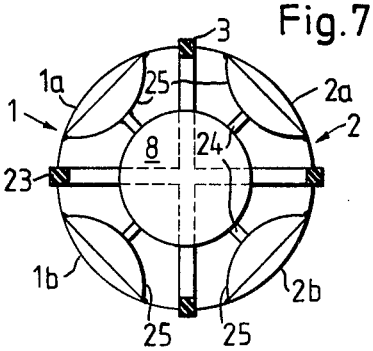
FIG. 7 is a section through a loudspeaker in accordance with the invention, this having four diaphragms.

The actuating unit 4 is of elongated form and is to be subject to vibrations along its longitudinal dimension dependent on the electrical signals applied thereto and to be converted into sound waves. The actuating unit 4 is so disposed within the interior of the pulsating sphere that the forces emanating therefrom, because of its variations of length, are transmitted to the two diaphragms 1 and 2 in directions at right angles to the plane connecting them. The actuating unit 4 may be as long as the diameter of the sphere formed by the diaphragm 1, 2 and be secured at its ends directly to these diaphragms 1, 2 at the crowns of the latter. With an arrangement of this sort, however, if the diaphragms 1, 2 are not made of a material which is sufficiently stable in shape, it may not be possible to avoid deformations of these diaphragms in the areas of their crowns by the longitudinal vibrations of the actuating unit 4. Deformations of the diaphragms 1, 2 at the crown area produce inherent vibrations or induced vibrations, preferably occurring in the crown zones, and the loudspeaker in this event will no longer be isotropic and will put out secondary waves. For this reason, despite the fact that the absolute variation in length is less, a shorter actuating unit 4 will be preferred as shown in FIGS. 1 and 4. This is connected to the two diaphragms 1 and 2 through transition parts 5 and 6 of non-varying shape which meet the diaphragms 1, 2 at right angles and are there cemented to them. The connecting points are spaced sufficiently far from the crown region of the two diaphragms 1 and 2. As a result the diaphragms 1, 2 move, largely without any shape change and as a stiff body, in dependence on the variations in length of the actuating unit 4. Preferably the transition parts 5 and 6 are connected to the diaphragms 1 and 2 at the inner sides of the latter in an area which defines a cone angle alpha (FIG. 1) between 60° and 90°. Like the diaphragms 1 and 2 the transition parts 5 and 6 must also be as light as possible so that they represent a minimally small inert mass, but they must be as stiff as possible so that they are not able to transmit movements imposed on them to the diaphragms 1, 2 without change in form. In the embodiment illustrated the two transition parts are made of a plastics material of non-varying shape, but they could also be of a light-weight metal alloy, the particular expanded aluminium or the like, for example duraluminium. The transition parts, as shown in FIGS. 1, 4 and 7, are of spherical cap form, that is to say a spherical calotte. This shape gives the caps, like the diaphragms 1, 2, superior stability of shape. Further it is possible to subtend an angle alpha in the angular range quoted, while at the same time to have an adequately long and thus advantageous actuating unit 4. The amplitude of the variation in length of the actuating unit 4 is, as implied above, dependent on the length and grows with increasing length of the actuating unit 4.

As indicated in FIGS. 1 and 4 each of the two transition parts 5 and 6 is in the form of a part-spherical cap and is firmly connected in the area of the crown thereof with an end part of the actuating unit 4. The arcuate edge of the cap is connected, and in particular cemented, to the associated diaphragm 1 or 2.

Figure 3:
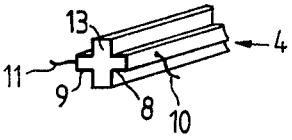
FIG. 3 is a perspective illustration of a further embodiment of a piezoelectric actuating unit.
Figure 2:
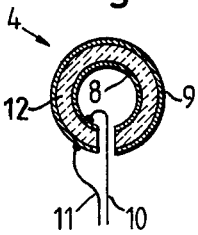
FIG. 2 is a section through another embodiment of a piezoelectric actuating unit.

The actuating unit 4 in the embodiment illustrated in FIG. 1 is constituted by a narrow prismatic plate 7 of a piezoelectric material. Two opposed faces of this plate are covered by electrically conducting electrode-forming layers 8 and 9. These are connected to electrical conductors 10 and 11 which are passed through openings left free in the ring 3, to have the electrical signal to be converted into sound waves applied thereto. To avoid the possibility of the piezoelectric actuating unit 4 being deformed otherwise than is wished, for example into bending vibrations, when the electrical signal is applied, the actuating unit 4 may be made as a tube 12 of piezoelectric material as shown in FIG. 2. The inner and the outer cylindrical surfaces are here coated with a metallic conducting layer to form electrodes 8 and 9. The actuating unit 4 of piezoelectric material may take the form of a rod 13 of cruciform cross section and be so made as to meet the object stated above, as shown in FIG. 3.

In FIG. 4 the actuating unit 4 is constituted by a rod 14 of circular cross section (or it could be some other cross section, for example square cross section), this rod 14 being made of a magnetostrictive material and having a coil 15 therearound. This is wound on a spool carrier 16 of greater internal diameter than the outer diameter of rod 14 and disposed between the spool carrier and the rod is a sleeve 17 of a soft material which allows variation in length of the rod 14 to take place without interference from the coil 15. On the other hand the longitudinal vibrations are not transmitted to the coil 15. Instead of providing a sleeve between the coil and the rod 14 the coil can be held in the connecting plane through suitable retaining means, for example a disc-formed inner wall.

Figure 5:
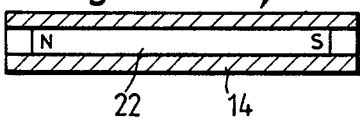
FIG. 5 is a longitudinal section through another embodiment of a magnetostrictive actuating unit.

As shown in FIG. 4 the electrical signals which are to be converted into sound waves are fed to the coil 15 through a transformer 18, the secondary winding of which is connected to the terminals of the coil 15 through two electrical conductors 19 and 20 which in turn are passed through suitable openings in ring 3. A source 21 of direct current is provided for polarising the rod 14. Instead of producing the polarising in this way the rod 14 could be hollow, that is to say be in the form of a tube, as shown in FIG. 5. In this arrangement a permanent magnet 22 is arranged in the interior of the hollow rod 14 to effect polarisation.

Figure 6:
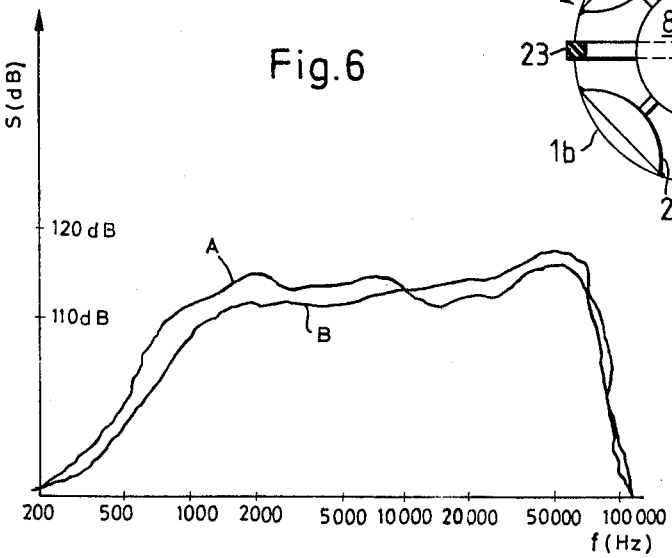
FIG. 6 is a graph of the frequency pattern of the sound pressure.

In the embodiment described above when an electrical signal to be transformed into sound waves is applied to the actuating unit 4 and through the conductors 10, 11 and 19, 20, the actuating unit 4 undergoes longitudinal vibrations the amplitude and frequency of which correspond to the amplitude and frequency of the electrical signal. The forces developed by these longitudinal vibrations are fed to diaphragms 1 and 2 causing them to reciprocate and thereby set the ambient air into fluctuations which can be heard as sound. Although the diaphragms 1 and 2 reciprocate in opposed directions along the longitudinal axis of the actuating unit it can be proven that the radiation in the area of these directions, designated by arrows F and G in FIG. 1, are substantially of the same size as those in the direction at right angles. Stated in other words the radiation from the loudspeaker is isotropic. The meter readings of this are shown in FIG. 6. Here the curve A of the sound pressure S is measured in the direction of arrows F and G, while the curve B is shown in a direction normal to this. Both curves A and B above the frequency f were measured by means of a classical form of measuring appliance, a microphone with a detecting surface of quarter of an inch diameter, that is 6.35 mm, being used. This microphone was arranged at a distance of about one meter from the loudspeaker in the direction of the arrow F for the curve A and in a direction at right angles to this for the curve B. The loudspeaker of the invention here tested had the following technical features: each of the two like diaphragms 1 and 2 had a diameter of 4 cm and was constituted by half a table tennis ball. The actuating unit 4 was constituted by a rectangular flat plate of piezoelectric material and had a length of about 20 mm. The ring 3 was made of a foamed soft plastics. The two transition parts 5 and 6 were of duraluminium and had a diameter of about 11 mm. The curves A and B exhibit outstanding identity over practically the complete frequency range.

In the embodiment of FIG. 7 each individual, hemispherical shell diaphragm 1 and 2 is divided into quarter-sphere shells (so-called digonous spheres) 1*a*, 1*b* and 2*a*, 2*b*. In this embodiment the four diaphragms 1*a* to 2*b* are connected one to another firstly, as described above, by means of the ring 3, and secondly, additionally through a ring 23 disposed around an equatorial plane. The rings 3, 23 are thus disposed at right angles to one another and, in a preferred instance, are in one piece. The actuating unit 4 is formed by a disc 8 of a piezoelectric ceramic material, the two disc surfaces of which are coated with a metallic conducting layer constituting the electrodes. Two terminal conductors are passed through an opening (not shown) provided in ring 3 or 23, for example in the transition areas of these rings, to enable an electrical signal to be passed to the electrodes. Four stiff transition parts connect the edge of the disc with the four diaphragms 1*a* to 2*b*. The arrangement is in mirror-image symmetry relatively to the two planes in which the rings 3 and 23 are disposed. As shown in FIG. 7 each transition part 5, 6 is formed by a short prop 24 and a spherical cap 25. The props 24 are offset at 90° to one another, and are each connected at one end to the edge of the disc 8 and at the other is fastened to the crown of the related cap 25. The circular rim of these spherical caps are, as in the embodiment of FIGS. 1 and 4, connected to the diaphragms 1*a* to 2*a*.

The embodiment of FIG. 7 has an action which is even more similar to the ideal of a pulsating sphere than those of preceding embodiments so that the sound radiation is even more isotropic.

Instead of using a resilient ring 3 or 23 a labyrinth seal could be provided in the transition areas between the diaphragms 1 and 2 because the rings 3 and 23 are not needed to center the diaphragms 1 and 2. A disc-form support part arranged at right angles to the actuating unit 4 and connected to the latter at the dead centre point of the vibration can advantageously be used to constitute the labyrinth seal.

It should be emphasised once again that the diaphragms 1 and 2 vibrate relatively to one another in opposite directions, that is to say either all the diaphragms move outwards or all the diaphragms move inwards. It is advantageous if the center of the sphere constituted by the diaphragms coincides with the centers of the individual diaphragms. The arrangement, particularly the suspension, of the loudspeaker according to the invention preferably occurs at the dead center point of the vibration, that is to say in the center of the actuating unit, but it could be performed through the conduits 11, 12 or directly at the ring 3 or 23.

The embodiments described above are merely provided to explain the invention and are not comprehensive of all possibilities, and further embodiments could be used within the present invention.

I claim:

1. A high-frequency loudspeaker having a displaceable diaphragm and, coupled to the diaphragm, an actuating unit which is adapted to vary in dimension in at least two directions under the effect of an applied electrical signal designed to be converted into sound waves, comprising:

the diaphragm being composed of two dimensionally-stable diaphragms which are each substantially hemispherical shells and are connected together by a resilient ring to form a closed substantially spherical variable-volume body, said resilient ring having at least one opening through which two electrical conductors are passed and connected to the actuating unit;

the actuating unit being: in the form of an elongated, staff single body; disposed inside the variable-volume body; firmly connected to each diaphragm so that impulse forces from the actuating unit are applied to the diaphragms in the directions running at right angles to a plane between the two diaphragms; capable of vibrating longitudinally along its axial length; and, arranged on the axes of symmetry of the two diaphragms;

means for equalizing the atmospheric pressure within and externally of the variable-volume body in such a way that no sound waves pass from the interior to the outer space; and, transmission parts for connecting the actuating unit to the diaphragms, each of the transmission parts having a crown and a circular ring, each crown connected to an end part of the actuating unit, and each of the diaphragms connected to the respective transmission part in the area of the circular ring.

2. A loudspeaker according to claim 1, wherein the actuating unit comprises a flat rectangular plate of a piezoelectric ceramic material, opposite faces of the plate being coated with a metallic conducting layer and forming electrodes for connection of the electrical conductors.

3. A loudspeaker according to claim 1, wherein the actuating unit is in the form of a tube made of a piezoelectric ceramic material, the tube having inner and outer cylindrical surfaces coated with a metallic conducting layer forming electrodes for connection of the electrical conductors.

4. A loudspeaker according to claim 1, wherein the actuating unit is formed by a rod of cruciform cross section and made of piezoelectric ceramic material, the rod having opposite faces which are coated with electrically conducting layers to form electrodes for connection of the electrical conductors.

5. A loudspeaker according to claim 1, wherein the actuating unit comprises a rod of a magnetostrictive material and an induction coil arranged around the rod, the electrical conductors passing through the at least one opening and being connected to the ends of the induction coil.

6. A loudspeaker according to claim 5, wherein the rod is hollow and further comprising a polarizing permanent magnet arranged in the interior of the magnet.

7. A loudspeaker according to claim 1, wherein the means for equalizing the atmospheric pressure comprises the ring being made of an air-permeable material.

8. A loudspeaker according to claim 1, wherein the means for equalizing the atmospheric pressure comprises the ring having at least one opening.

9. A loudspeaker according to claim 1, further comprising:

each diaphragm being formed by two diaphragms of like shape, each having a one-quarter spherical face;

an additional ring arranged in a plane at right angles to that of the first ring, the four diaphragms being connected through the two rings;

the actuating unit being formed by a disc of piezoelectric ceramic material, the disc having faces which are in each case covered by a metallic conducting layer forming electrodes;

the ring having at least one opening through which two electrical conductors are passed and connected to the electrodes to enable an electrical signal to be conducted to them from the exterior; and, four rigid transition parts of non-varying shape connecting edges of the disc with the four diaphragms, whereby the assembly is arranged in true symmetry to the plane in which the rings are disposed.

10. A loudspeaker according to claim 9, wherein each transition part comprises a short prop and a spherical cap, the prop being fastened at one end part to the disc and at the other end part with the crown of the spherical cap, the circular periphery of each spherical cap being connected to one of the diaphragms.

11. A loudspeaker according to claim 1, wherein the transition parts are in the form of spherical caps.

* * * * *